United States Patent [19]

Siegenthaler

[11] Patent Number: 4,823,694

[45] Date of Patent: Apr. 25, 1989

[54] DEVICE FOR FEEDING SEVERAL PAPER WEBS TO A PRINTER

[75] Inventor: Fritz Siegenthaler, Trub, Switzerland

[73] Assignee: Autelca AG., Gümligen, Switzerland

[21] Appl. No.: 223,096

[22] Filed: Jul. 22, 1988

[30] Foreign Application Priority Data

Sep. 28, 1987 [CH] Switzerland ..... 03713/87

[51] Int. Cl.[4] ..... B41F 13/56

[52] U.S. Cl. ..... 101/227; 242/58; 242/67.2; 242/67.3 R; 226/119; 400/614

[58] Field of Search ..... 101/228, 224–227; 400/614; 242/58, 67.2, 67.3 R; 226/108–109, 118–119, 196, 198, 182, 183, 190–192

[56] References Cited

U.S. PATENT DOCUMENTS

| | | | |
|---|---|---|---|
| 860,026 | 7/1907 | Hawley | 400/614 |
| 1,208,322 | 12/1916 | Johnson | 400/614 |
| 1,208,757 | 12/1916 | Dennis | 400/614 |
| 1,234,728 | 7/1917 | Carson | 400/614 |
| 1,537,971 | 5/1925 | Sundstrand | 242/67.3 R |
| 2,504,021 | 4/1950 | Heinrich | 101/227 |
| 2,808,258 | 10/1957 | Waychoff | 226/119 |
| 2,970,535 | 2/1961 | Schmutz | 101/227 |
| 3,069,155 | 12/1962 | Fulk | 101/227 |
| 4,920,054 | 1/1988 | Hood et al. | 242/58 |

FOREIGN PATENT DOCUMENTS

| | | | |
|---|---|---|---|
| 1251726 | 10/1971 | United Kingdom | 242/58 |

*Primary Examiner*—E. M. Eickholt

*Attorney, Agent, or Firm*—Brady, O'Boyle & Gates

[57] ABSTRACT

In order to accommodate a relatively large number of paper storage reels (11–17) with diameters of relatively large size in correspondence with a relatively large paper reservoir in a space of relatively small dimensions, storage reels (12–15) are also arranged in side-by-side relationship, i.e. laterally offset with respect to the paper feed slots (21–27) of the printer (20). The path segments of the paper webs (2–5) extending in this case in part skewed with respect to the paper feeding direction of the printer are made possible by rerouting members (52/62, 53/63, 54/64, 55/65, 42–45) at which the paper webs are guided on a rerouting path extending along part of a helical winding.

7 Claims, 3 Drawing Sheets

DEVICE FOR FEEDING SEVERAL PAPER WEBS TO A PRINTER

The invention relates to a device for feeding the paper webs of several storage reels to paper feed slots, arranged in parallel side-by-side, of a printer, especially a ticket printer, wherein respectively one of the introduced paper webs is conveyed to a printing station, imprinted, the printed section of paper web is cut off and issued.

BACKGROUND OF THE INVENTION

In such printers, the paper webs are fed to the slots by way of guide rollers, the guiding directions being disposed in a plane perpendicular to the slots; for this purpose, the storage reels have heretofore been arranged in superimposed or series relationship, and their axes, as well as the axes of all guide rollers, have been disposed in parallel to the slots.

In this arrangement, the installation of the storage reels is such that the latter occupies a narrow housing space corresponding to the width of one, or the broadest, paper web and, respectively, storage reel; the imprinted and severed paper web pieces (especially tickets, for example) are issued at the forward narrow side of this housing space. Only a few (e.g. three) storage reels can be disposed in superposition since the desired large reservoir of each paper web requires storage reels having a large diameter, wherein even the topmost reel is to be accessible from the floor for exchange purposes. A series arrangement of the storage reels is practically hardly possible on account of the depth of the device which in such a case must be dimensioned to be large, inasmuch as such devices (particularly automatic ticket dispensers, for example) are in most instances set up alongside a wall from which they are not to project too far.

In this connection, the invention is to provide a remedy. The invention, as characterized in claim 1, solves the problem of creating a device of the type discussed hereinabove making it possible to guide paper webs, from storage reels or also from at least one storage reel arranged to be laterally offset to the slots in the slot direction, to the slots so that storage reels can also be disposed side-by-side in the axial direction.

SUMMARY OF THE INVENTION

The advantages attained by the invention are to be seen essentially in that, with storage reels located in side-by-side relationship, a compact, space-saving arrangement is obtained without increasing the depth dimension of the device, even in case of a relatively large number of storage reels having a relatively large diameter and web reservoir.

BRIEF DESCRIPTION OF THE DRAWINGS

The invention will be described in greater detail below with reference to the schematic drawings appended hereto which show merely one way of carrying out the invention. In the drawings.

DESCRIPTION OF THE PREFERRED EMBODIMENT

Figure 1:
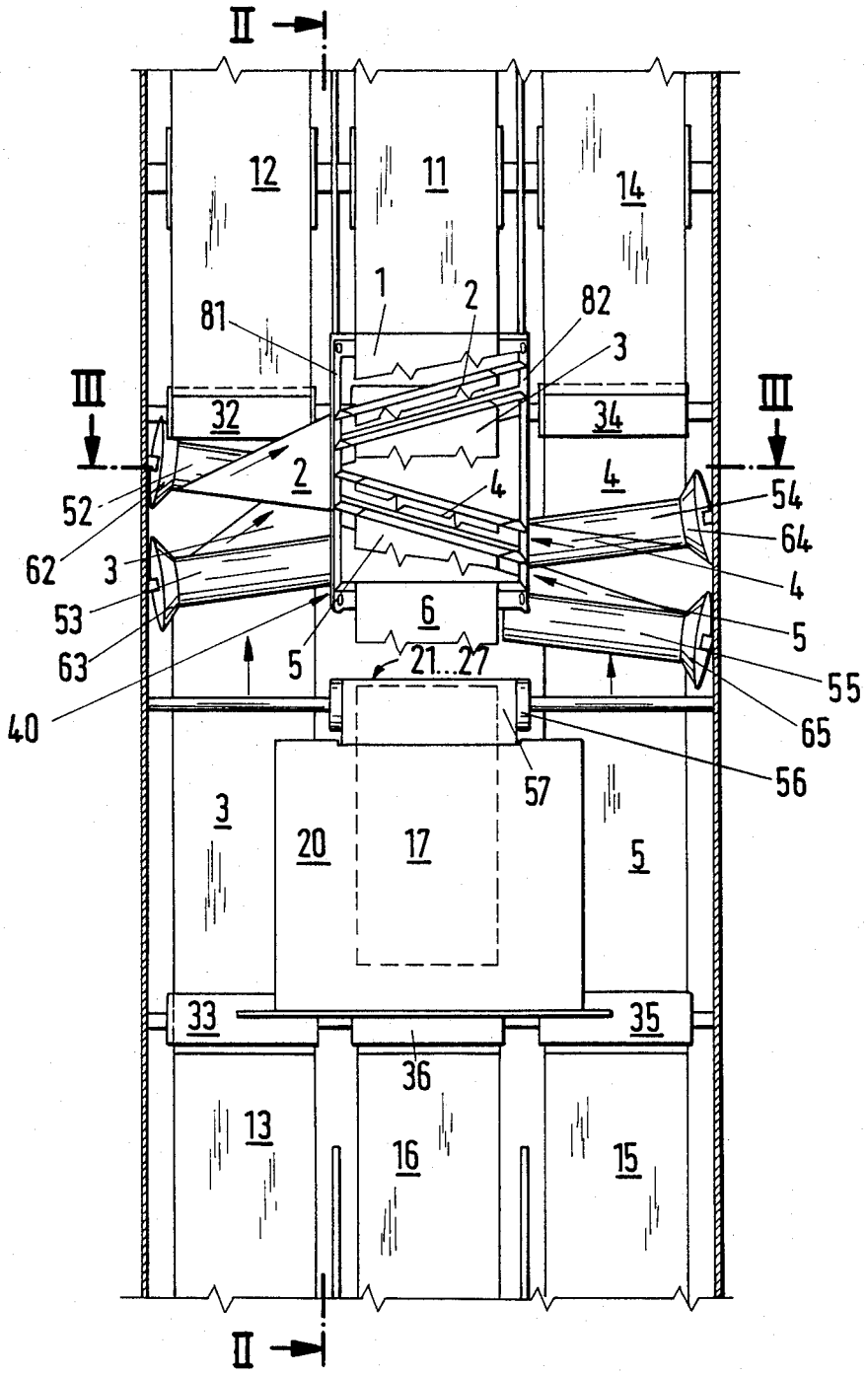
FIG. 1 is a front view of the device with the printer without a front wall, seen in the viewing direction I of FIGS. 2 and 3.

By means of the illustrated device, seven paper webs 1–7 are guided each by respectively one of the storage reels 11–17 to a printer 20, not illustrated in detail, e.g. a fare ticket printer having, for each paper web 1–7, one of seven feed slots 21–27. In the printer 20, respectively one of the paper webs 1–7 introduced into the slots 21–27 is conveyed to a printing station, not shown, imprinted, the printed section of paper web is cut off and issued. Such a printer has been known from EP-A-0 048,329. In this conventional printer (not shown in detail herein), the slots 21–27 constitute the inlets of guide channels arranged to converge in fan shape toward a pair of drums. In the rest condition, each paper web extends up to the outlet of the guide channel provided therefor. Each guide channel is equipped with a gripper retaining the paper web in the rest position. The gripper for the paper web to be imprinted in a particular case advances the latter until it has passed into the clamping nip of the rotating drum pair, then releases this web, and remains initially in its advanced position. The pair of drums transports the paper web further, first into its imprinting position, after printing into its severing position, and after severing again backwards. Before the paper web has left the clamping nip, the gripper again engages and returns into its rest position, entraining the paper web so that its end created by the severing step enters the position occupied by its previous, free end prior to advancement of the gripper. In this way, it is possible to effect printing in any desired sequence on various paper webs and also in direct succession on one and the same paper web.

Each of the storage reels 11–16 is associated with one of the guide rollers 31–36, from which the paper web travels in a direction independent of the diameter of the paper roll that becomes smaller with diminishing reservoir.

A dancer 40 which will be described in greater detail below is associated with the paper webs 1–6; this dancer comprises a rerouting member 41–46 for each of these paper webs 1–6, the paper web traveling from this member to the slot of slots 21–26 intended for this particular web.

The storage reels 11, 16, 17 are disposed in superposition and arranged, just as the guide rollers 31, 36 and the rerouting members 41, 46 with their axes and, respectively, axes of curvature in parallel to the slots 21–27 so that all path segments of the paper webs 1, 6 and 7 extend perpendicularly to the slots 21–27. In this arrangement, the paper web 1 travels about the guide roller 31 along a circular arc and in the same way (i.e. again along a circular arc) on a sliding surface of the rerouting member 41 of the dancer 40; the paper web 6 travels along a circular arc about two guide rollers 36, 56 and likewise along a sliding surface of the rerouting member 46 of the dancer 40; and the paper web 7 runs along a circular arc on a rerouting member 57 constituted by a baffle. In this arrangement, all linear path segments and all circular-arc-shaped path segments, and accordingly all rerouting angles of the paper webs, 1, 6 and 7 lie in a plane perpendicular to the feed slots 21–27.

The storage reels 12–15 are arranged to be laterally offset with respect to the feed slots 21–27, so that the storage reels 12, 13 are located on one side (in FIG. 1 the left-hand side) and the storage reels 14, 15 are located on the other side (in FIG. 1 the right-hand side) of the feed slots 21–27 and of the storage reels 11, 16, 17 as well as of the dancer 40 located above the feed slots 1–7. In the illustrated embodiment, the axes of the storage reels 12–15 extend in parallel to those of the storage reels 11, 16, 17 and to the feed slots 21–27. Although this is not a necessity, it makes it possible to arrange the storage reels 12, 14 closely beside the storage reel 11, and the storage reels 13, 15 closely beside the storage reel 16, in a space saving fashion.

Along their routes, leading obliquely from the rear toward the front laterally and upwards or downwards, the paper webs 2–5 must be rerouted about angles into planes extending obliquely to the axes of the storage reels 11–17 and obliquely to the feed slots 21–27. For this purpose, the paper web 4 is guided, for example, along a deflection route extending along part of a helical winding about a rerouting member constituted by a rotatably supported roller 54 with a flange 64, and thereupon again along a deflection route extending along part of a helical winding over a curved sliding surface of a further rerouting member 44 of the dancer 40. Actually, any required rerouting angle can be formed in the required plane by two tangents of a helical winding (the rerouting angle being understood to mean the angle formed by the initially skewed tangents if one of them is shifted in parallel in such a way that it intersects the other). The path running along part of a helical winding evolves perforce from the oblique position of the axis of the guide roller 54 with the flange 64 and, respectively, the axis of curvature of the rerouting member 44 and from the feeding direction and the take-off direction (which latter is practically vertical at the rerouting member 44). The paper strip 4 has the tendency to enter the guide roller 54 at a point migrating continuously toward the right in FIGS. 1 and 3, rearwardly in FIG. 2, as would be the case with a helical windup onto the guide roller 54. In order to prevent this from happening, the flange 64 of the rerouting member 54/64 is formed or mounted to be conical and at the end of the roller 54, from which the path extending along the helical winding leads away on account of the pitch of the helical line. At this end, the rim of the paper web 4 first runs up on the flange 64. While the paper web 4 travels about the rerouting member 54/64, the web slides axially on the roller 54 in the direction pointing away from the flange 64 so that the web retains its lateral position at the rerouting member 54/64. If the rerouting member 54/64 is formed with a fixed sliding surface instead of by the roller 54 and the flange 64, then a lateral guidance means corresponding to the flange 64 is superfluous. It has been found that it is enough to guide the rims of the paper web 4 at the ends of the feed slot 24.

The axis of the rerouting member 54/64 is skew with respect to the axes of the guide roller 34 and the storage reel 14, as well as the slots 21–27. The axis of curvature of the rerouting member 44 lies in the feeding plane of the slots 21–27, but is inclined with respect to the slot direction. In this arrangement, the two rerouting angles of the rerouting members 54/64 and 44 lie in planes extending obliquely in space. Thereby the paper web 4 is guided along path sections that are oblique to all three perpendicular coordinates (of the coordinate system given, for example, by the planes of illustration of FIGS. 1–3) from the guide roller 34 to the rerouting member 44 at the dancer 40 and finally enters linearly into the feed slot 24 of the printer 20.

The paper webs 2, 3, 5 are conducted from the guide rollers 32, 33, 35 to the slots 22, 23 25 in i correspondence with the guidance of the paper web 4 from the guide roller 34 to the slot 24 so that the remarks rendered with regard to the guidance of the paper web 4 and with regard to the guide members 54/64 and 44 thereof apply analogously to the guidance of the paper webs 2, 3 5 and their guide members 52/62, 42; 53/63, 43; 55/65 45.

At the dancer 40, the rerouting members 41–46, each comprising a cylindrically curved sliding surface, are attached with their ends to two approximately vertical spars 81, 82. The thus-formed lattice frame is guided to be approximately vertically movable by means of a linear guide arm linkage with two parallelogram guide arms 83, 84. A torsion spring 85 engages at the guide arm 84 and absorbs the weight of the dancer 40 and of the paper webs 1–6 acting thereon, and temporarily yields at the beginning of the feed of one of the paper webs 1–6 resting on the rerouting members 41–46 of the dancer until the larger adhesive friction of these webs has changed to the smaller sliding friction. In this operation, only the dancer 40 is moved first of all, and only thereafter will the paper web be conveyed and will the rotatable rerouting members about which the web travels, as well as the storage reel, be driven. Thereby the tension exerted on the paper web is reduced and a lesser advancing power of the grippers suffices, which grippers have been mentioned above in the explanation of the printer.

For each storage reel there are suitably provided a feeler (not shown) transmitting in case the reservoir drops below a certain magnitude a signal to the control apparatus of the printer, and a brake (not illustrated) ensuring the tension of the paper web required for reliable guidance and preventing further rotation of the storage reel on account of its inertia after a feeding step of the paper web, which would relax the paper web.

Figure 2:
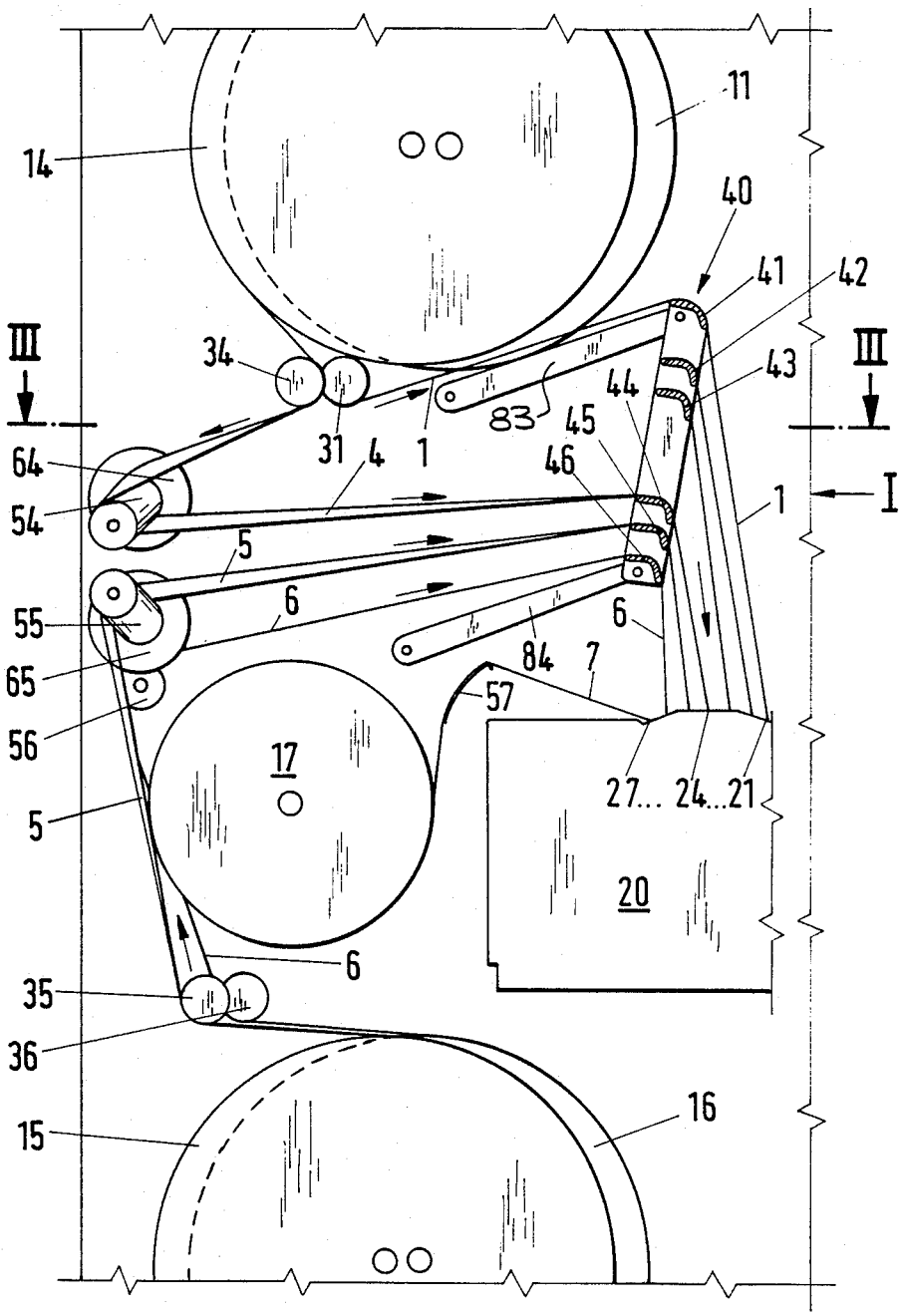
FIG. 2 is a lateral view in section along line II—II in FIGS. 1 and 3.
Figure 3:
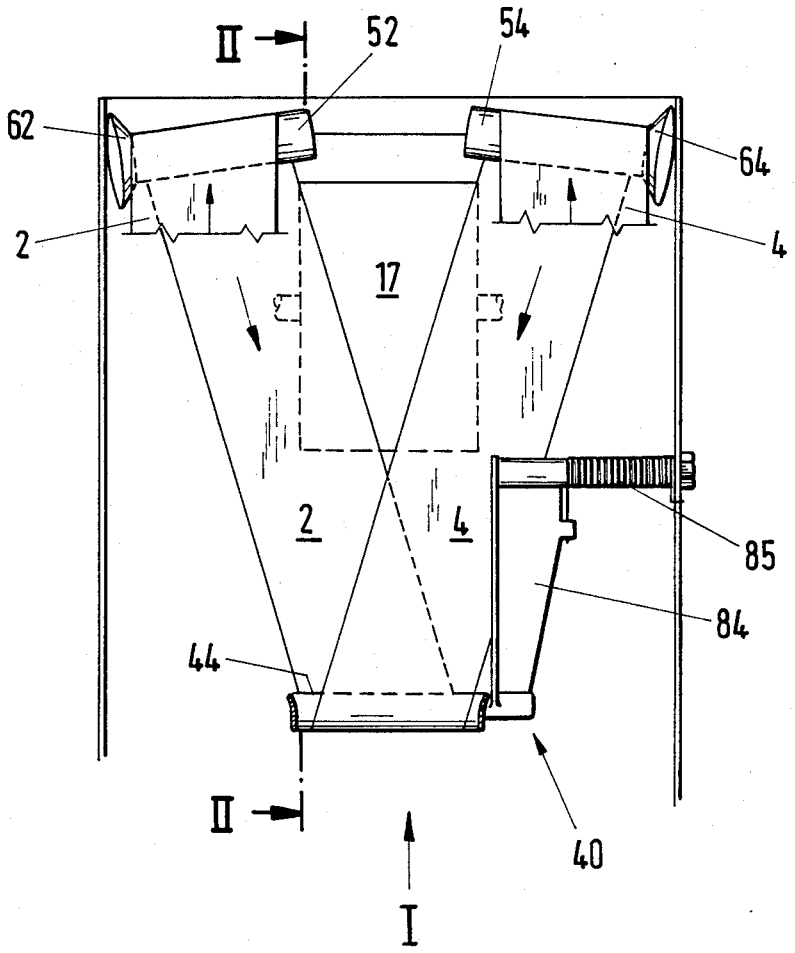
FIG. 3 is a top view in section along line III—III in FIGS. 1 and 2.

In FIG. 2, the two storage reels 11, 14 and 15, 16, as well as the two guide rollers 31, 34 and 35, 36 are illustrated to be mutually offset in order to separately depict the route of the paper webs 1, 4 and 5, 6. Of course, instead of the illustrated arrangement, a coaxial one is likewise possible.

In place of the guide rollers 31–36, it is also feasible to utilize rerouting members having a fixed sliding surface; for example, in place of the guide rollers 31, 32, 34, a first round bar and, in place of the guide rollers 33, 35 and 36, a second round bar can be provided, extending transversely to the device.

I claim:

1. Device for feeding the paper webs (1–7) of several storage reels (11–17) to paper feed slots (21–27), arranged in parallel side-by-side, of a printer (20), wherein respectively one of the introduced paper webs is conveyed to a printing station, imprinted, the printed section of paper web is cut off and issued, characterized in that at least one (12–15) of the storage reels (11–17) is arranged to be laterally offset with respect to the paper feed slots (21–27); and that the paper web (2–5) thereof is rerouted at least one rerouting member (52/62, 53/63, 54/64, 55/65, 42–45) on a rerouting path extending along part of a helical winding.

2. Device according to claim 1, characterized in that at least one of the rerouting members (42–45), at which a paper web (2–5) is rerouted along a rerouting path extending along part of a helical winding, exhibits an at least approximately cylindrically curved sliding surface for the paper web.

3. Device according to claim 1, characterized in that at least one of the rerouting members (52/62, 53/63, 54/64, 55/65), at which one of the paper webs (2–5) is rerouted along a rerouting path extending along part of a helical winding, is a rotatably supported roller (52, 53, 54, 55) having a conical flange (62, 63, 64, 65) at the end from which leads away the rerouting path of the paper web (2–5) extending along part of a helical winding, so that the paper web that is being fed runs up on the flange (62, 63, 64, 65) with a longitudinal rim (2–5) and, during rerouting, slides axially along the roller of the rerouting member (52/62, 53/63, 54/64, 55/65) turned by the paper web (2–5) that is being rerouted.

4. Device according to claim 1, characterized in that the axis of at least one storage reel (e.g. 14) offset laterally with respect to the feed slots extends in parallel to the slots (21–27); that its (14) paper web (4) is rerouted about a first rerouting member (54/64) and thereafter about a second rerouting member (44), in each case along a rerouting path extending along part of a helical winding; that the helical axis of the first rerouting member (54/64) is skew with respect to the axis of the storage reel (14) and the helical axis of the second rerouting member (44) extends at least approximately in the slot plane, skew with respect to the slot direction.

5. Device according to claim 1, characterized in that at least one storage reel (12–15) arranged offset laterally to the slots (21–27) is associated with a rerouting member (32–35) on which the paper web (2–5) of the storage reel is rerouted along a rerouting path, having a circular arc curvature with an axis of curvature in parallel to the axis of the storage reel, into a direction, independent of the respective reservoir, to a rerouting member (52/62, 53/63, 54/64, 55/65), the rerouting path of which extends along part of a helical winding.

6. Device according to claim 1, characterized in that a dancer (40) elastically resilient in the feeding direction to the slots (21–27) has, for each storage reel (e.g. 14) arranged laterally offset with respect to the slots, one (44) of the rerouting members, the helical axis of which extends at least approximately in the feeding plane to the slots (21–27), skew to the slot direction, in order to reroute the paper web (4), fed obliquely to the rerouting member (44), on a rerouting path extending along part of a helical winding into a direction leading perpendicularly to the associated slot (44).

7. Device according to claim 1, characterized in that there are arranged, in the forward portion of the device, the printer (20) and, above the printer (20), a dancer (40) guiding paper webs (1–6) to the slots (21–26), that there are supported, behind the printer (20), a first storage reel (17) of a smaller diameter, above this reel (17) a second reel (11) and below this reel (17) a third storage reel (16) of larger diameters, with axes extending in parallel to the slots (11–17); that the paper webs (7, 1, 6) of the first, second and third storage reels (17, 11, 16) each are guided about at least one rerouting member (57; 31; 36, 56) along a circular-arc-shaped rerouting path with an axis of curvature in parallel to the slots (21–27) in the forward direction toward the dancer; that a fourth (12) and fifth (14) storage reel each is supported on one side of the second storage reel (11) and also a sixth (13) and seventh (15) storage reel each is supported on one side of the third storage reel (16) with axes in parallel to the slots (21–27); and that each of the paper webs (2–5) of the fourth to seventh storage reels (12, 14, 13, 15) is rerouted about a rerouting member (32, 34, 33, 35) on a circular-arc-shaped rerouting path with an axis of curvature in parallel to the slots (21–27) in the direction toward a rerouting member (52/62, 53/63, 54/64, 55/65) arranged in the rear part of the device approximately at the level of the dancer (40), and is rerouted at this rerouting member on a rerouting path extending along part of a helical winding with a helical axis skew with respect to the slots (21–27) into a direction leading obliquely forwardly to the dancer (40) at a rerouting member (42, 43, 44, 45) of the dancer (40) on a rerouting path extending along part of a helical winding, the helical axis of which is approximately in the feeding plane of the feed slots (22–25) obliquely to the slot direction, in the direction toward the feed slot (21–25) provided for the paper web (2–5).

* * * * *